US007059503B2

(12) United States Patent
Andersen

(10) Patent No.: US 7,059,503 B2
(45) Date of Patent: Jun. 13, 2006

(54) DEVICE FOR RESTRAINING AND PROTECTING NECKSTRAP-SUPPORTED USER EQUIPMENT

(76) Inventor: M. Dan Andersen, 404 S. 300 East, Brigham City, UT (US) 84302

( * ) Notice: Subject to any disclaimer, the term of this patent is extended or adjusted under 35 U.S.C. 154(b) by 36 days.

(21) Appl. No.: 10/215,308

(22) Filed: Aug. 8, 2002

(65) Prior Publication Data

US 2003/0029895 A1 Feb. 13, 2003

Related U.S. Application Data

(60) Provisional application No. 60/311,168, filed on Aug. 9, 2001.

(51) Int. Cl.
*A45F 5/00* (2006.01)

(52) U.S. Cl. ..... 224/579; 224/578; 224/623; 224/626; 224/648; 224/649; 224/909

(58) Field of Classification Search ..... 274/578, 274/579, 603, 604, 605, 607, 623, 625, 626, 274/627, 637, 638, 640, 646, 647, 648, 649, 274/654, 656, 909; D3/218
See application file for complete search history.

(56) References Cited

U.S. PATENT DOCUMENTS

| | | | | |
|---|---|---|---|---|
| 469,444 | A * | 2/1892 | Frazier | 224/649 |
| 1,479,008 | A | 1/1924 | Powers | |
| 1,618,088 | A | 2/1927 | Hinrichs | |
| 1,827,524 | A | 10/1931 | Hilburger | |
| 2,574,143 | A | 11/1951 | Colby | |
| 2,990,089 | A | 6/1961 | Nystrom | |
| 3,152,738 | A | 10/1964 | Worsfold | |
| 3,209,968 | A | 10/1965 | Flanagan | |
| 3,258,182 | A | 6/1966 | McDonald | |
| 3,305,148 | A | 2/1967 | Zimmerman | |
| 3,307,757 | A | 3/1967 | Gatos et al. | |
| 3,326,430 | A | 6/1967 | Banks | |
| 3,326,431 | A | 6/1967 | Belleni | |
| 3,326,432 | A | 6/1967 | Banks et al. | |
| 3,374,508 | A | 3/1968 | Slimovitz | |

(Continued)

FOREIGN PATENT DOCUMENTS

DE 66298 8/1914

OTHER PUBLICATIONS

"Spring Clips", John F. Maguire Co., Inc., Pawtucket, R.I. Advertisement.

(Continued)

*Primary Examiner*—Gary E. Elkins
(74) *Attorney, Agent, or Firm*—Morriss, O'Bryant, Compagni, P.C.

(57) ABSTRACT

A restraining and protection device for the protection and the restraint of neckstrap-suspended equipment used in the field, comprises a flexible cover of sufficient size to envelope most surfaces of the equipment. Attached to or associated with the cover is one strap that extend around the user's waist. A second strap is attached to the equipment so as to extend around the user's neck, or alternatively over one of the user's shoulder as desired. The ability to change the configuration of the straps is accomplished by providing an interconnection between the straps such that the waist strap can loop through the neck strap when the device is in a harness-type configuration and separated to change the device to an over-the-shoulder configuration with the equipment positioned proximate the user's hip.

14 Claims, 7 Drawing Sheets

U.S. PATENT DOCUMENTS 3,507,424 A 4/1970 Burkins
3,526,347 A 9/1970 Kuban
3,528,720 A 9/1970 Treace
3,583,600 A * 6/1971 Scott ..... 224/646
3,611,444 A 10/1971 Rector
3,782,614 A 1/1974 Campisi
3,797,717 A 3/1974 Collins
3,884,403 A 5/1975 Brewer
3,910,470 A 10/1975 Swenson et al.
3,937,373 A 2/1976 Artz
3,966,101 A 6/1976 Taylor, III
3,982,675 A 9/1976 Claypool
3,990,617 A 11/1976 Carter
4,033,488 A 7/1977 Brewer
4,054,167 A 10/1977 Rausch
4,058,242 A 11/1977 Brewer
4,069,955 A 1/1978 Noyes
4,071,066 A 1/1978 Schaeffer
4,135,653 A 1/1979 Sieloff
4,136,726 A 1/1979 Lee
4,148,422 A 4/1979 Habler
4,168,022 A 9/1979 Brewer
4,232,808 A 11/1980 Gray
4,266,300 A 5/1981 Partridge
4,320,863 A * 3/1982 Lyer et al. ..... 224/637
4,349,139 A 9/1982 Oishi
4,416,405 A 11/1983 Caillouet
4,421,150 A 12/1983 Masters
4,461,411 A 7/1984 Harrow
4,500,019 A 2/1985 Curley, Jr.
4,556,159 A 12/1985 Swain
4,705,086 A 11/1987 O'Neill
4,751,950 A 6/1988 Bock
4,865,191 A 9/1989 Easter
4,898,311 A 2/1990 Boyer
4,923,060 A 5/1990 Breslau
4,924,557 A 5/1990 Heckerman et al.
5,016,797 A 5/1991 Rowledge
5,065,919 A 11/1991 Sims
5,114,061 A 5/1992 Brady
5,172,838 A 12/1992 Rowell et al.
5,184,764 A * 2/1993 Orovan et al. ..... 224/637
5,263,838 A 11/1993 Mauser et al.
5,320,261 A * 6/1994 Andersen ..... 224/909
5,360,149 A 11/1994 Lucot
5,398,855 A 3/1995 Schaiewitz
5,400,935 A * 3/1995 Farmer ..... 224/623
5,692,661 A * 12/1997 Kellerman ..... 224/648
5,816,464 A * 10/1998 Seiler ..... 224/623
D436,723 S * 1/2001 Ankri ..... D3/218
RE37,155 E 5/2001 Anderson
6,345,751 B1 * 2/2002 Elliot ..... 224/646
6,481,606 B1 * 11/2002 Pickett ..... 224/637

OTHER PUBLICATIONS

"Snugger Camera Strap" Advertisement by Sunrise Creations—about May 1990.
"Soft Pouch" Optech USA, Eagle Optics, Madison, Wisconsin Catalog & Advertisement—Winter 1994.
"Kuban Hitch II" Kurt Manufacturing Company, Minneapolis, Wisc. , package, about 1990.

* cited by examiner

DEVICE FOR RESTRAINING AND PROTECTING NECKSTRAP-SUPPORTED USER EQUIPMENT

CROSS-REFERENCE TO RELATED APPLICATION

The present application claims priority to U.S. Provisional Patent Application Ser. No. 60/311,168 filed on Aug. 9, 2001.

BACKGROUND

1. Field of the Invention

This invention relates to protective covering and restraining devices for user equipment which are suspended by a neckstrap positionable about the neck, and specifically relates to a protective covering structured to allow the user equipment, such as binoculars or a camera, to be restrained against the user until ready for use.

2. Background of the Invention

There are many different types of protective and restraining devices designed for use with neckstrap- or harness-suspended equipment. Some prior art devices serve to hold the user equipment in place against the user's body, while others have been developed to solely protect the user equipment from being damaged by exposure to the elements (i.e., sun and rain). Prior art devices have been developed to serve both the purposes of restraining and protecting the user equipment. Such devices are often complicated and expensive, however.

Harness type devices keep user equipment weight off the user's neck by applying at least some equipment weight to both shoulders of the user, but are very inconvenient to use when the user changes, for example, from wearing heavy outer clothing to lighter clothing, or vise versa. Harness devices also tend to be expensive and complicated to use. Devices for use with neckstrap-suspended equipment are easy and comfortable to use when the user is wearing heavy outer clothing, but when the user wears lighter clothing the weight applied to the user's neck is uncomfortable.

The Quick Release™, a harness-type mechanism marketed by Sunrise Creations, is an example of a complicated device which only provides restraint to the user equipment, not protection. The device comprises straps which engage the user device and extend over the shoulders and a strap which goes around the chest. A third strap secures the shoulder straps to the chest strap. The chest strap is constructed with hook and loop tabs which hold the user equipment firmly in place against the user's body. This requires extra attachments to the user equipment and makes it much more cumbersome and inconvenient to use when the user needs to remove or add outer clothing.

U.S. Pat. RE37,155E discloses a device similar to the present invention for securing the user equipment in place against the user's body and protecting the equipment while secured in place. That invention, however, cannot remove all weight from the user's neck like the present invention. The patent discloses a protective covering for the user equipment which is strapped about the user's abdomen. The protective covering holds neckstrap-suspended user equipment against the user's body preventing it from moving about or swinging away from the body. It does, however, allow the neckstrap of the user equipment to hang loose, leaving open the possibility that the neckstrap could slide off of the neck of the user. More importantly, the body-encircling strap which holds the protective cover in place against the user's abdomen may slip down the body causing some degree of inconvenience to the user.

Therefore, it would be advantageous in the art to provide a device which can be used to allow user equipment to hang from a neckstrap in a secure, protected manner and that can keep equipment weight off the user's neck without the use of a separate harness in a simple, secure, protected manner. It would also be advantageous to provide a device which can be easily and quickly changed from an around-the-neck, harness-type orientation to an over-the-shoulder arrangement in which the equipment is secured to the user's body proximate the user's hip. Moreover, it would be advantageous to provide a device which is structured to facilitate easy removal of the device away from the user's body and easy placement against the user's body.

SUMMARY OF THE INVENTION

The present invention provides an equipment cover and restraining device to be worn by a user when carrying such equipment as a pair of binoculars, a still or video camera, a water bottle or other device that is typically carried by a user when hiking, walking or engaging in other activities. Thus, the equipment cover can be modified or configured to fit a particular piece of equipment. The equipment cover and carrying device of the present invention substantially prevents the equipment secured thereby from swinging as the user moves by holding the equipment against the user's body. Moreover, the present invention comfortably distributes the weight of the equipment and makes it quickly and easily accessible.

An important feature of the present invention is the ability to quickly and easily change the configuration of the equipment harness from a neck-type harness system in which the equipment is positioned in front of the user's torso (e.g., the chest or waist) to an over-the-shoulder system in which the equipment is positioned proximate the side of the user under the arm or proximate the hip. The configuration of the harness system is easily adjustable to any user regardless of size.

The harness system of the present invention is also relatively inexpensive to manufacture, is non-product specific, and can be made out of a wide variety of materials. Moreover, the present invention is easy to use and can be used while doing many activities. Furthermore, the present invention can be used with many different types of clothing, is very quiet to use, is easily stowed away when not in use, is lightweight, and provides neckstrap-suspended equipment protection from rain, dust, and damage due to impact.

The harness system of the present invention is configured to restrain and protect neckstrap-suspended user equipment in a non-swinging covered manner. The harness system comprises a neckstrap for positioning about the neck of a person with an opening or connecting device located near a mid-point of the neckstrap. The neckstrap is connected to the piece of user equipment. A protective covering for enclosing the equipment suspending from said neckstrap is attached to a body-encircling band or strap. The body-encircling strap may be detachably attached to the covering. In addition, the body-encircling strap can be threaded through the opening or coupled to the connecting device of the neckstrap.

When the neckstrap is worn about the neck of the user, with the user equipment suspended from the neckstrap and in front of the user, the body-encircling strap can be coupled to the neckstrap at the midpoint of the neckstrap to pull the neckstrap away from the back of the neck of the user. The body-encircling strap which is connected to the cover holds the cover and thus the equipment against the body of the user while the interconnection between the neckstrap and body-encircling strap places the weight of the user equipment at a much more comfortable position, on the shoulders of the user and away from the neck.

The cover may be made of a flexible material so as to form around the equipment or a customized rigid cover for fitting around a particularly configured piece of equipment. In the case of a flexible cover, an elastomeric or elastic material that has longitudinal elastic properties may be attached around a perimeter of the cover so as to form a pouch for receiving the equipment therein, the elastic material employed to at least partially close the cover around the equipment and hold the cover to the equipment. The opening formed by the elastic material, is positioned to the back of the cover and against the user's body, such that the cover provides protection to the equipment on the exposed surfaces.

In one embodiment, the coupling device comprises a ring coupled to the neckstrap such that the neckstrap is formed from two lengths of material, each attached between the ring and the user equipment. The body-encircling band can then be looped through the ring to form a harness for supporting and maintaining the user equipment relative to the body of the user.

By removing the body-encircling band from engagement with the ring, the neckstrap can be worn over one shoulder of the user with the cover positioned proximate the side opposite the one shoulder of the user.

The neckstrap and body-encircling band can be made to interconnect proximate a midpoint of the neckstrap by any means known in the art.

In another embodiment, the body-encircling band is releaseably connected to said cover so as to allow the cover to stay on the user equipment during use by the user.

In yet another embodiment, the cover configured to be removed from the user equipment in order to release the equipment from the cover and thus the body-encircling band. Thus, once the equipment is removed, the cover remains attached to the body-encircling band while the user equipment is only retained relative to the user by the neckstrap.

In still another embodiment, the neckstrap is configured to be selectively lengthenable between a first length for positioning around the neck of a user and a second length for positioning over one shoulder of the user. To facilitate ease of adjustment, the neckstrap may be formed from a longitudinally elastic material or have a portion formed therein for providing longitudinal elasticity.

The harness system of the present invention may be employed for use with various types of user equipment including without limitation a pair of binoculars, a still camera, a video camera, a water bottle, a spotting scope, and a range finder.

DETAILED DESCRIPTION OF THE INVENTION

In accordance with the present invention, a device for protecting and supporting neckstrap-suspended user equipment is provided which comprises a body-encircling strap or band, a protective covering for housing the user equipment, and a neckstrap structured to engage the user equipment and also structured to allow lacing engagement or otherwise engage the body-encircling strap to facilitate easy attachment and removal of the device from the user's body. The present invention provides a means of supporting and protecting the user equipment while allowing ease of access and use while not encumbering the equipment.

Figure 1:
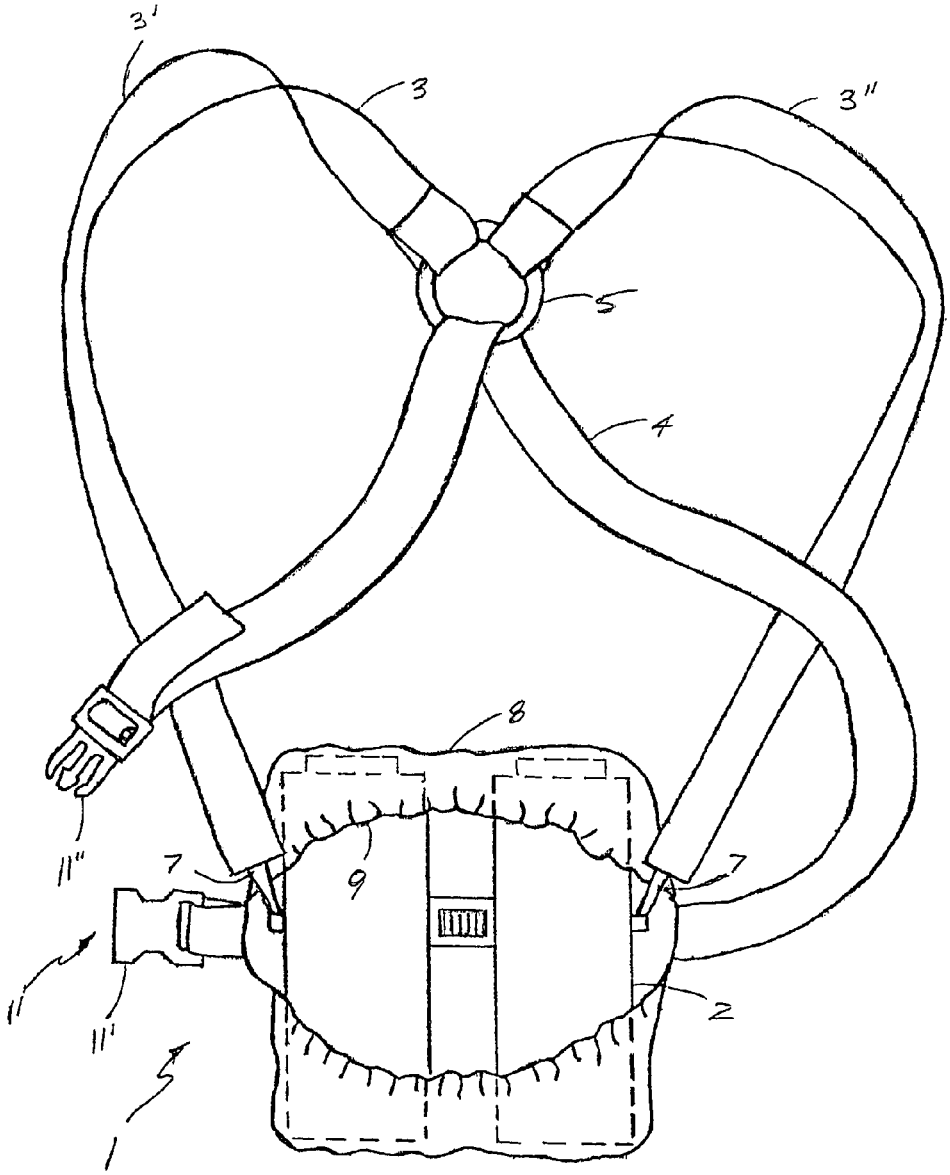
FIG. 1 is a back view of first embodiment of a device for protecting and supporting neckstrap-suspended user equipment in accordance with the principles of the present invention.

Referring now to the drawings, FIG. 1 illustrates a back view of a harness system, generally indicated at 1, for restraining and protecting a piece of equipment 2, in this case a pair of binoculars, relative to the body of a user wearing the harness system 1. The harness system 1 is generally comprised of a first strap 3 configured to fit around the neck of a user and a second strap 4 configured to encircle or otherwise extend around a substantial portion of the torso of a user. The first strap 3 is comprised of a first strap portion 3' and a second strap portion 3" of approximately equal length. Interposed between the first and second strap portions 3' and 3" is a coupling or interconnecting device 5 to which the first and second strap portions 3' and 3" are attached. In this example, the coupling device 5 is comprised of a single ring member about which the proximate ends of the first and second strap portions 3' and 3" are attached as by overlapping the ring member and attaching the ends back upon the strap portions 3' and 3" as by sewing or adhesively attaching as shown. The free or terminal ends of the strap 3 are coupled to the user equipment 2 as with hooks or clasps 7 that are configured to attach to the equipment 2.

The second strap 4 is attached to a protective cover 8 that is configured to fit around at least a portion of the equipment 2. The cover 8 includes an elasticized opening 9 to help maintain the cover 8 on the equipment 2. The opening 9 is positioned against the user when the harness system 1 is worn so that the majority of exposed surfaces of the equipment 2 is protected by the cover 8.

The second strap 4 is fixedly attached to the cover 8 at one end and releaseably attached to the cover 8 at a second end as with a buckling mechanism 11 comprised of interconnecting buckling members 11' and 11". The engagement of the strap 4 with the buckling member 11" allows the effective length of the strap 4 to be easily adjusted by pulling the strap 4 through the buckling member 11".

To form a harness system about a user, the second strap 4 is threaded through the ring member 5 and the buckling members 11' and 11" are connected. When the buckling members 11' and 11" are connected, the cover 8 is then secured against the body of the user and the strap portions 3' and 3" are positioned over the shoulders of the user. The interconnection of the strap 4 with the ring member 5 causes the strap members 3' and 3" to be pulled down the user's back and away from the user's neck, thus relieving pressure that would otherwise be caused by the weight of the equipment from the neck of the user.

Figure 2:
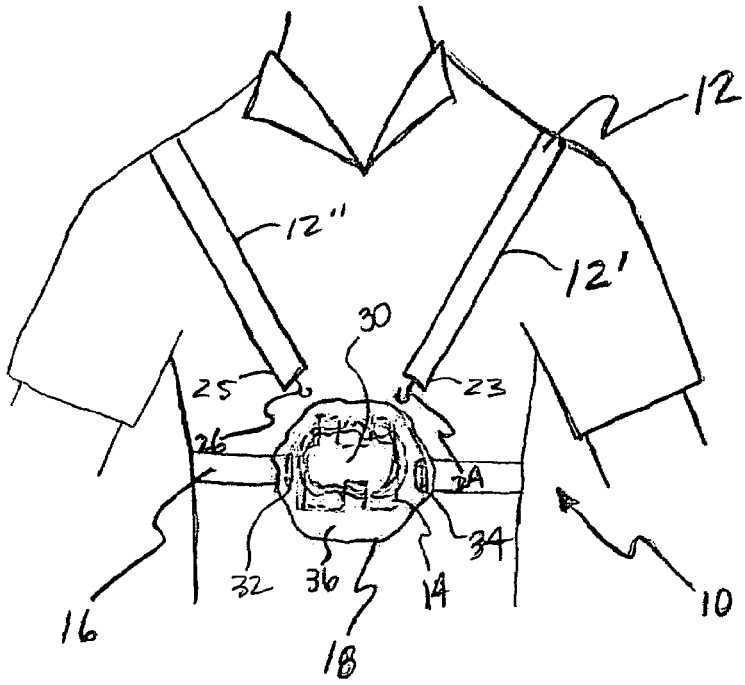
FIG. 2 is a front view of a second embodiment of a device for protecting and supporting neckstrap-suspended user equipment attached to a user in accordance with the principles of the present invention.
Figure 3:
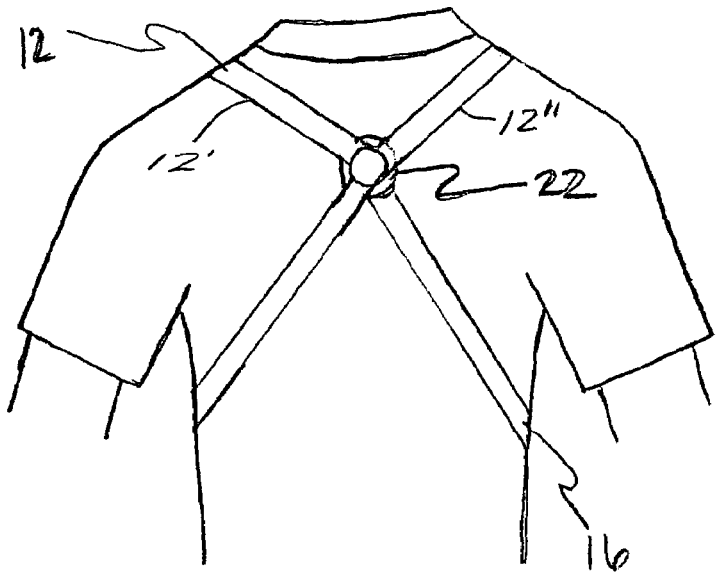
FIG. 3 is back view of the device for protecting and supporting neckstrap-suspended user equipment shown in FIG. 2.

FIGS. 2 and 3 show a front view and a back view, respectively, of a person upon whom a restraining and protective device, generally indicated at 10, of the present invention is positioned. The device 10 comprises a neckstrap 12 for positioning about the neck of the user. The neckstrap 12 has a selected length and an opening 22 located near a mid-point of the selected length, as specifically shown in FIG. 3. The opening 22 may be provided in the form of a ring or other similar device or may be an opening formed in the fabric or material of the neckstrap 12.

It is also contemplated that a plurality of rings 22 may be employed. For example, a pair of spaced apart rings along the length of the neckstrap 12 may be utilized with the body-encircling strap threaded through both rings 22 to have a similar effect as when employing a single ring 22, as illustrated.

Figure 4:
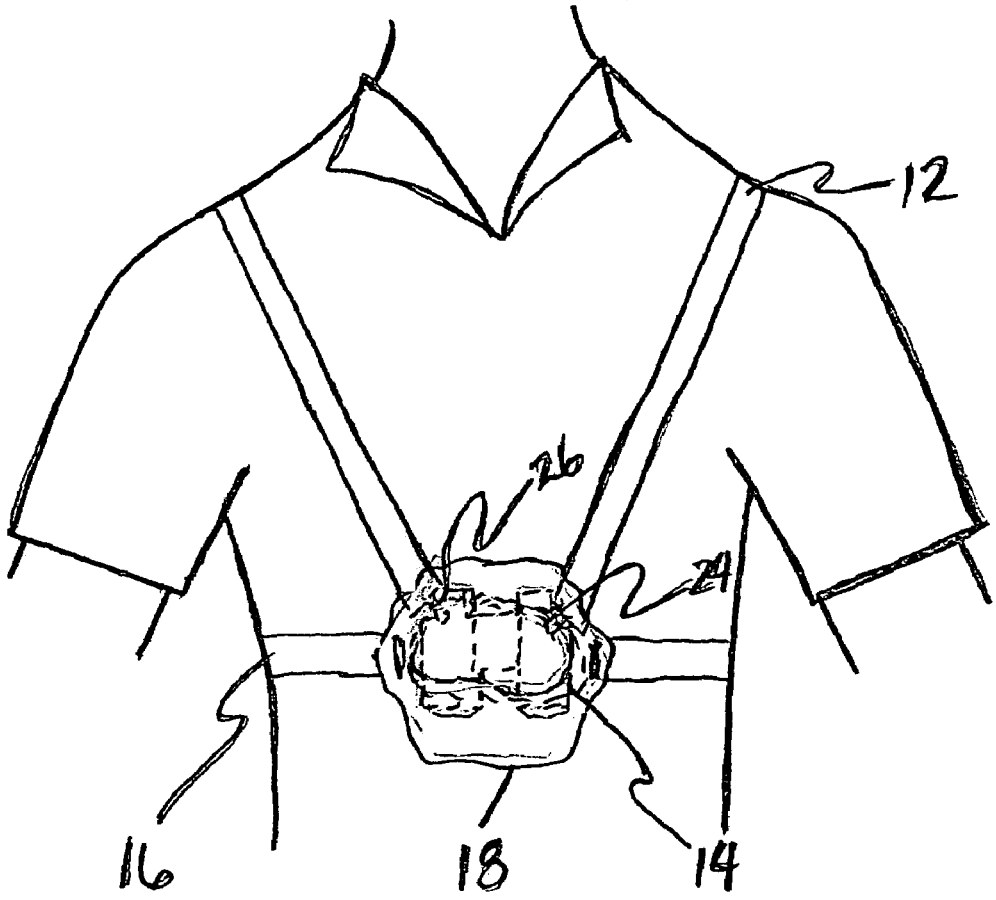
FIG. 4 is another front view of the device for protecting and supporting neckstrap-suspended user equipment shown in FIG. 2.

As illustrated, the opening 22 is comprised of a ring, which may be formed of plastic or other suitable material with the neckstrap 12 comprised of two separate lengths of material 12' and 12" connected at their ends to the ring 22. The components 12' and 12" of the neckstrap are of equal length so as to have the ring 22 attached proximate the midpoint of the entire length of the neckstrap 12. The neckstrap 12 has two terminal or free ends 23 and 25 at opposing extremities of its length and attachment mechanisms 24, 26 are located at each terminal end. The attachment mechanisms 24, 26 provide for attachment of the user equipment 30 to the neckstrap 12, as further illustrated in FIG. 4. The neckstrap 12 may be structured to permit adjustment of the length thereof.

The device 10 of the present invention further comprises a body-encircling strap 16 which is sized to adjustably fit about a user's body. The body-encircling strap 16 may be comprised of a longitudinally elastic material so as to allow the strap 16 to stretch and provide some resiliency and longitudinal stretching of the device 10 to provide a tight fit of the strap 16 to the user without unwanted constriction. The strap has two opposing terminal ends 32, 34, shown in phantom in FIG. 2, which secure in some fashion to a protective covering 18. One of the terminals ends 32, 34 may be permanently secured to the protective covering 18 by, for example, stitching. The other terminal end 32, 34 is detachably attachable to the protective covering 18 to allow the user to position the body-encircling strap 16 about the user's body as shown. Alternatively, both terminal ends may be detachably attachable to the protective covering 18.

The protective covering 18 consists of a single expanse of flexible material, preferably also being waterproof. However, any material having properties which produce a flexible water resistant cover could be used. FIG. 2 illustrates that the protective covering 18 has an outer extremity 14 (shown in phantom) which, preferably, has an elastomeric material secured in proximity thereto. For example, the outer extremity 14 of the protective covering 18 may be formed with a casing through which a length of elastic material is positioned to cause the outer extremity 14 to gather inwardly toward itself, thereby forming a pocket 36. The protective covering 18, therefore, has an expandable opening. The protective covering 18 is of sufficient size or dimension to allow for the covering of approximately 98% of all neckstrap-suspended equipment surfaces oriented away from the user's body. The protective covering 18 holds the user equipment firmly against the user preventing it from moving or being damaged.

In use, the user attaches one end of the flexible band 16 to the protective covering 18 if the device 10 is of an embodiment where both terminal ends 32, 34 are detachably attached to the protective covering 18. The free terminal end 32, 34 is then threaded through the opening 22 in the neckstrap 12 as shown in FIG. 3. The user then encircles his body with the flexible strap 16 and attaches the free terminal end 32, 34 to the protective covering 18. The ends of the neckstrap 12 bearing attachment mechanisms 24, 26 are then brought over the shoulders of the user and the attachment mechanisms 24, 26 are attached to the user equipment 30. The user equipment 30 is then placed in the protective covering 18 by increasing the size of the elasticized opening of the protective cover 18 to accommodate the size of the user equipment 30. For example, a pair of neckstrap-suspended binoculars is protected and restrained from movement by first stretching the outer extremity 14 of the cover 18 around and over the lower portion of the suspended binoculars which covers the lenses facing down. Next, the protective covering 18 is stretched up, over, and around the upper portion of the suspended binoculars covering the lenses facing up. The device 10 of the present invention may also be placed on the user's body by attaching the user equipment 30 to the neckstrap 12 as previously described, threading the body-encircling band 16 through the opening 22, placing the neckstrap about the user's neck and securing the body-encircling band 16 in place about the user's body. The user equipment 30 is then positioned in the protective covering 18 as previously described.

Due to the elastomeric action of the protective covering 18 and the elastic outer extremity 14 of the protective covering 18, the device 10 is kept in position to cover nearly all outwardly oriented surfaces of the user equipment 30. The only surfaces of the binoculars 30 not covered are those which are oriented against the user and small areas near the neckstrap 12 attachment mechanisms 24, 26.

Figure 5:
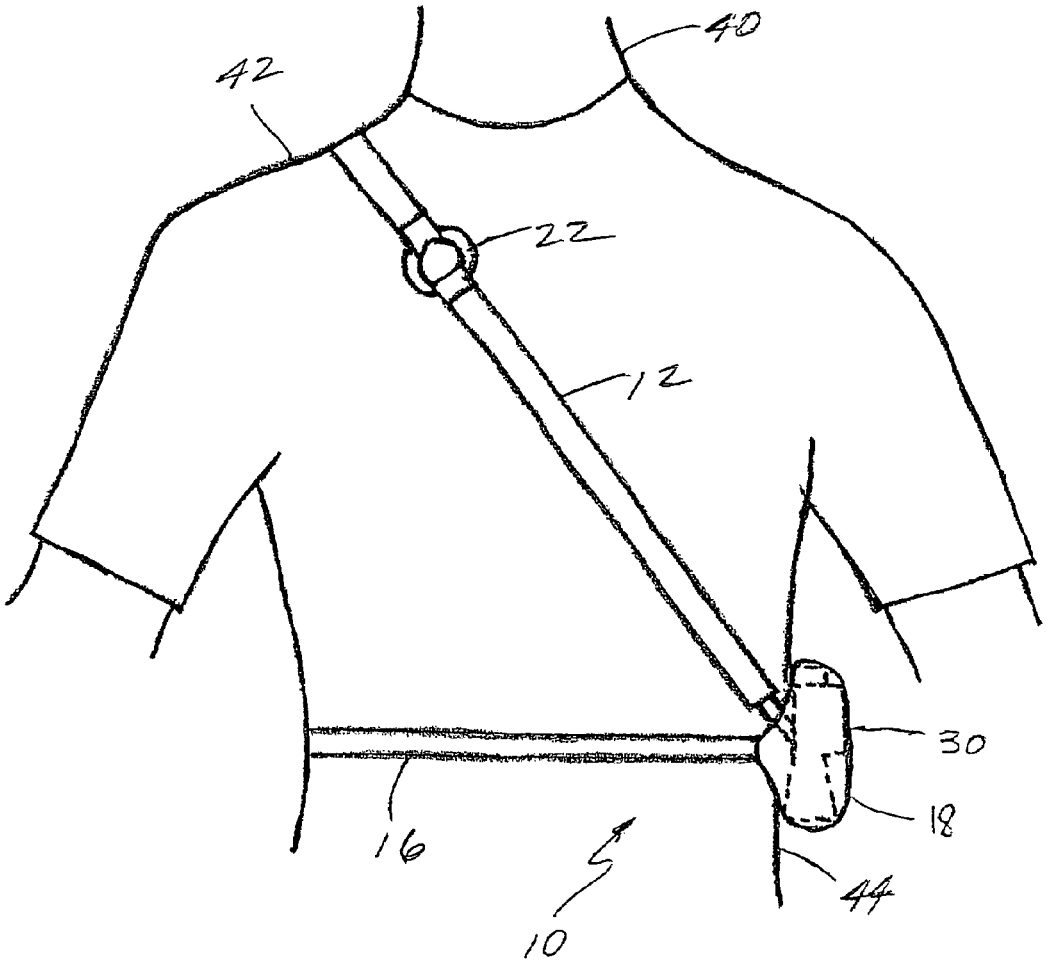
FIG. 5 is a back view of the device shown in FIGS. 2, 3 and 4 in an alternative configuration.

As further illustrated in FIG. 5, the device 10 can be selectively reoriented by the user 40 to fit over one shoulder 42 of the user with the user equipment 30 and cover 18 positioned at the side 44 of the user 40 opposite the one shoulder 42. To do so, the body-encircling strap 16 is removed from engagement with the ring 22 and the neckstrap 12 is moved into position over one shoulder. If needed, the neckstrap 12 is adjustable in length to provide proper fit when changing device configurations. In such an orientation, the neckstrap 12 supports the weight of the user equipment 30 relative to the user while the body-encircling strap 16 holds the equipment 30 to the side 44 of the user 40 to significantly reduce bounding of the equipment 30 relative to the user 40 as a result of movement of the user 40.

Figure 6:
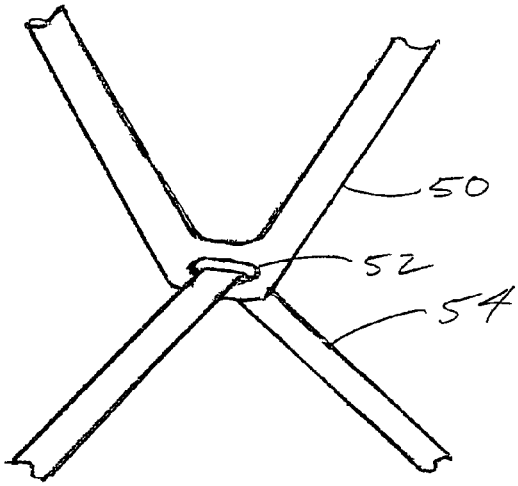
FIG. 6 is a back view of a second embodiment of a means for interconnecting the first and second straps of a harness system in accordance with the principles of the present invention.
Figure 7:
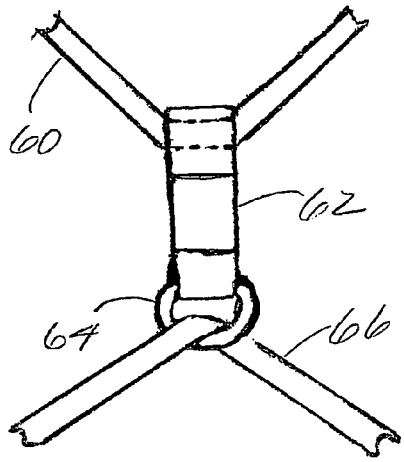
FIG. 7 is a back view of a third embodiment of a means for interconnecting the first and second straps of a harness system in accordance with the principles of the present invention.
Figure 8:
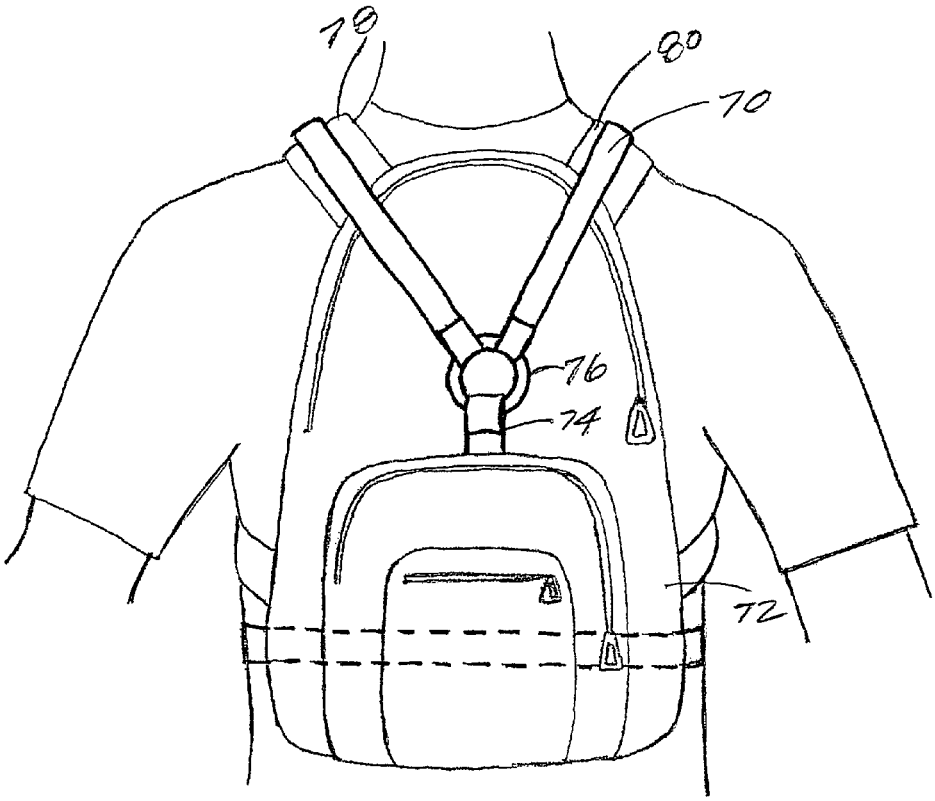
FIG. 8 is a back view of a third embodiment of a device for protecting and supporting neckstrap-suspended user equipment attached to a backpack in accordance with the principles of the present invention.

As shown in FIGS. 6 and 7, various types of engagement may be utilized between the neckstrap and the body-encircling strap. For example, the neckstrap 50 shown in FIG. 6 may itself define an opening 52 therein proximate a midpoint of the neckstrap 50. The body encircling strap 54 can then be threaded or laced through the opening 52 to provide the desired engagement in accordance with the principles of the present invention. Likewise, as shown in FIG. 7, the neckstrap 60 may comprise a continuous section of material with an intermediate strap 62 coupled to the neckstrap 60. A ring 64 is then attached to the opposite end of the intermediate strap for engaging the body encircling strap 66. It is further contemplated in FIG. 8 that the neckstrap 70 may be coupled to a separate piece of clothing or user equipment, such as a backpack 72. An engaging tab or hook 74 that is attached to the backpack 72 may be configured to engage a ring 76 coupled to the neckstrap 70. In such a fashion, the midpoint of the neckstrap 70 is pulled away from the back of the neck of the user such that the weight supported by the neckstrap 70 is positioned on the shoulders of the user. Moreover, the position of the interconnection of the neckstrap 70 to the backpack 72 can be such that the neckstrap 70 lies on top of the shoulder straps 78 and 80 of the backpack, as such shoulder straps 78 and 80 are typically padded and would effectively provide padding to the neckstrap 70.

Figure 9:
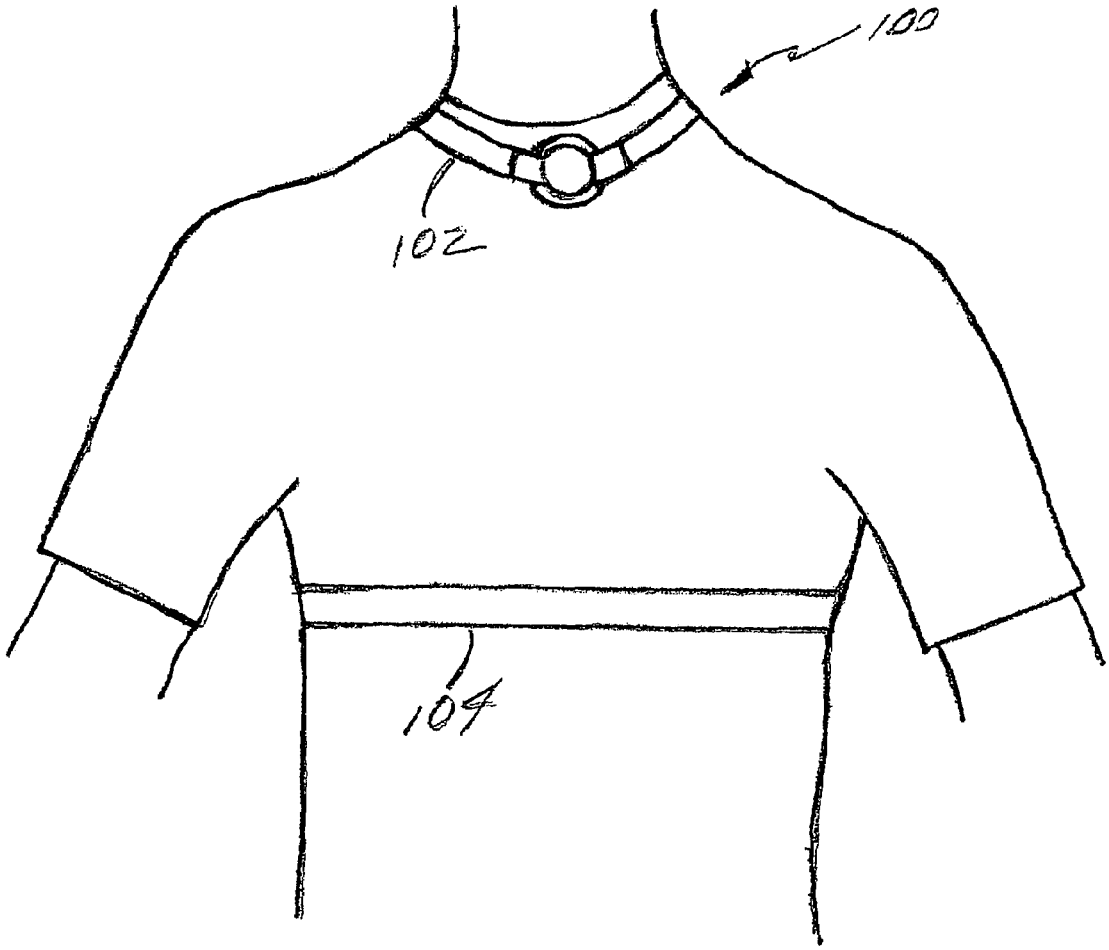
FIG. 9 is a back view of the device shown in FIGS. 2, 3, 4 and 5 in yet another alternative configuration.

As shown in FIG. 9, the harness system 100 in accordance with the present invention may be worn with the neckstrap 102 positioned about the neck of the user and the body-encircling strap 104 positioned about the torso of the user without direct engagement between the two straps 102 and 104.

It is further contemplated that the body-encircling strap may be configured to be selectively removable from the cover. It is often the case that certain user neck-supported equipment comes with its own protective cover that is contoured to the equipment and allows use of the equipment without requiring removal of the cover during use. As such, the body-encircling strap may be a continuous strap with an attachment mechanism such as a combination of hook and loop fastener between the strap and the cover to allow for easy and selective removal of the cover, and thus the equipment contained therein, from the body-encircling strap. It is also contemplated that snaps or other quick release fasteners known in the art may be utilized, such as the buckle 11 shown in FIG. 1.

The present device aids in preventing the loss or damage of neckstrap-suspended user equipment. The user equipment is also prevented from swinging when the user is in motion. The present device allows the user equipment to be easily removed from the cover in order to be used. The present invention also allows the device to be easily positioned on and removed from the user. Most importantly, the configuration of the present invention allows the device to be more securely positioned on the user's body and prevents the neckstrap from weighing on the user's neck.

It is to be understood that the above-described embodiments are only illustrative of the application of the principles of the present invention. Numerous modifications and alternatives may be devised by those skilled in the art, including combinations of the various embodiments, without departing from the spirit and scope of the present invention. The appended claims are intended to cover such modifications, alternative arrangements, and combinations.

What is claimed is:

1. An apparatus for restraining and protecting neckstrap-suspended user equipment in a non-swinging covered manner comprising:

a neckstrap for positioning about the neck of a person, said neckstrap having a length and having an opening located near a mid-point of said length;

a protective covering for enclosing a piece of equipment suspending from said neckstrap; and a body-encircling band detachably attached to said protective covering, said body-encircling band being threaded through said opening of said neckstrap.

2. The apparatus of claim 1, wherein said covering is made of a flexible material employing at an outer extremity of said covering, elastomeric material which is different than the covering, the elastomeric material stretching and contracting along its length and being of suitable size to provide restraint and protection of the piece of equipment by stretching action of said elastomeric material attached to said covering.

3. The apparatus of claim 2, wherein said opening comprises a ring coupled to said neckstrap, said band capable of being selectively looped through said ring.

4. The apparatus of claim 3, wherein said band is removable from said ring to allow said neckstrap to be worn over one shoulder of a user with the cover positioned proximate the side opposite the one shoulder of the user.

5. The apparatus of claim 1, wherein said opening comprises means for selectively interconnecting said band to said neckstrap.

6. The apparatus of claim 1, wherein said band is releaseably connected to said cover.

7. The apparatus of claim 1, wherein said neckstrap is configured to be selectively adjustable between a first length for positioning around the neck of a user and a second length for positioning over one shoulder of a user and wherein said neckstrap is longitudinally elastic.

8. The apparatus of claim 1, wherein said piece of equipment comprises one of a pair of binoculars, a still camera, a video camera, a water bottle, a spotting scope, and a range finder.

9. The apparatus of claim 1, wherein said covering is configured to be removed in order to release the piece of equipment from the band.

10. The apparatus of claim 1, wherein said covering is configured to allow said piece of equipment to be used with said covering attached to said piece of equipment and said covering is selectively releaseable from said band.

11. An apparatus for restraining and protecting user equipment relative to the body of a user, comprising:

a cover configured for fitting at least partially around a piece of equipment for protection of said piece of equipment, said cover being made of a flexible material and comprising an elastomeric material attached proximate an outer edge of said cover to provide restraint and protection of a piece of equipment by the elastic action of said elastomeric material;

a first strap having a first end and a second end, said first and second ends being configured to couple to a piece of equipment in a manner to freely suspend the piece of equipment from said first strap to be instantly removable from said cover, said first strap having a length sufficient to fit at least around a user's neck and having a coupling means comprising a ring coupled to said first strap proximate a mid-point of said length; and a second strap coupled to said cover having a length sufficient to extend around the torso of a user and to be coupled to said first strap by said coupling means proximate a mid-point of said first strap, said second strap being configured for looping through said ring.

12. The apparatus of claim 11, wherein said second strap is removable from said ring and said first trap is sized in length to allow said first strap to be worn over one shoulder of a user with the cover positioned proximate a side of the user opposite the one shoulder.

13. An apparatus for restraining and protecting user equipment relative to the body of a user, comprising:

a cover configured for fitting at least partially around a piece of equipment, said cover being made of a flexible material and comprising an elastomeric material attached proximate an outer edge of said cover to provide restraint and protection of a piece of equipment by the elastic action of said elastomeric material;

a first strap having a first end and a second end, said first and second ends coupled to said piece of equipment, having a length sufficient to fit at least around a user's neck;

at least one coupling device coupled to said first strap for selectively attaching said first strap relative to a user away from the back of the neck of the user to thereby remove the weight of the equipment from the neck of the user, said coupling device comprising a ring coupled to said first strap proximate a midpoint thereof and being configured for coupling to a second strap; and a second strap releaseably coupled to said first strap having a length sufficient to extend around the torso of a user, said second strap capable of being looped through said ring.

14. The apparatus of claim 13, wherein said second strap is removable from said coupling device and wherein said first strap is sized in length to allow said first strap to be worn over one shoulder of a user with the cover positioned proximate a side of the user opposite the one shoulder.

* * * * *